United States Patent [19]

Borner

[11] 4,183,166

[45] Jan. 15, 1980

[54] ARTICULATED TOY

[76] Inventor: Alfred Borner, Pickliessemer Str. 3, 5521 Dudeldorf, Fed. Rep. of Germany

[21] Appl. No.: 841,646

[22] Filed: Oct. 12, 1977

[30] Foreign Application Priority Data

Oct. 27, 1976 [DE] Fed. Rep. of Germany ..... 2648696

[51] Int. Cl.[2] ..... A63H 33/00; A63H 15/00

[52] U.S. Cl. ..... 46/1 R

[58] Field of Search ..... 46/1

[56] References Cited

U.S. PATENT DOCUMENTS

| | | | |
|---|---|---|---|
| 2,310,711 | 2/1943 | Savage | 46/1 R |
| 2,809,467 | 10/1957 | St. Pierre et al. | 46/1 R |
| 3,530,614 | 9/1970 | Strongin | 46/1 R |

*Primary Examiner*—Russell R. Kinsey
*Assistant Examiner*—Robert P. Swiatek
*Attorney, Agent, or Firm*—Cushman, Darby & Cushman

[57] ABSTRACT

This invention relates to toys of the kind consisting of tablets which are preferably rectangular in shape and which are able to move under gravitational influence, being connected uninterruptedly together by tapes so as to be able to move in such a way that if the first tablet is taken hold of and the other tablets are allowed to hang free, then one face of the tablets is visible and if the first tablet is turned down in front of the next tablets below it, then all the tablets which are not held automatically turn over, whereupon the other face of the tablets is visible. According to the invention the tapes consist of segments of equal length having thickened end-pieces and each tablet is given cut-outs parallel to and spaced from the narrow sides of the tablet, which are adjacent adjoining tablets: the shape of the cut-outs allow them to receive and interengage with the end-pieces of the tapes.

1 Claim, 9 Drawing Figures

ARTICULATED TOY

BACKGROUND OF THE INVENTION

The present invention relates to toys of the kind comprising a series of preferably rectangular tablets which are able to move under gravitational influence and which are connected uninterruptedly together by tapes so as to be able to move, in such a way that if the first tablet is taken hold of and the other tablets are allowed to hang free then one face of the tablets is visible, and if the first tablet is turned down in front of the tablet next below it then all the tablets which are not held automatically turn over, after which the other face of the tablets is visible. Hereinafter such toys will be referred to as "of the kind described".

Toys of the kind described are for example known and used as props for conjuring shows. They generally consist of flat tablets of wood or cardboard to which the tapes are stuck.

A disadvantage of this is that, due to the tractive strains which occur each time the toy is operated, the tapes easily come unstuck. Also, the assembly of such a toy is comparatively complicated.

It is an object of the invention therefore to provide a toy of the kind described in which the tapes and tablets which are required can be connected together in a simpler, quicker and more durable fashion than hitherto. In particular the invention is intended to create conditions which enable the toy to be manufactured as an inexpensive mass-produced article.

SUMMARY OF THE INVENTION

This and other objects are achieved by having the tapes consist of segments of equal length having thickened end-pieces and by giving each tablet cut-outs parallel to and spaced from the narrow sides of the tablet, which are adjacent adjoining tablets, the shape of the cut-outs allowing them to receive and interengage with the end-pieces of the tapes.

Advantageously, the inside width of the cut-outs is larger or smaller than their width where they open onto the faces of the tablets and the end-pieces of the tapes consist of a resilient material.

If desired, the cut-outs may widen in the direction of alternate ones of the two faces of the tablets: the cut-outs may be trapezium-shaped in cross-section.

Furthermore, the cut-outs may be bounded by parallel inside faces and at least one inside face of each cut-out may have a small ridge to fix an end-piece of a tape in position.

Advantageously the tablets have parallel longitudinal ridges to guide the tapes, and the surface of the ridges may extend parallel to the surface of the rest of the table.

One suitable way of manufacturing the tablets is by injection-moulding from plastics material.

The end-pieces may be composed of plastics material and be injection moulded onto the tapes.

Advantageously the tapes are transparent.

The advantages of the invention lie above all in the fact that the toy can easily be pre-fabricated and can be assembled ready for use with only a few operations, while withstanding even long and hard use without suffering damage.

BRIEF DESCRIPTION OF THE DRAWINGS

In order that the invention may be more clearly understood reference will now be made to the accompanying drawings which show some embodiments thereof by way of example and in which:

FIG. 2 is a plan-view of three successive tablets, without the tapes being shown, FIG. 3 is a section on line A—A or the conforming line C—C shown in FIG. 2, but including the tapes situated on the section line, FIG. 4 is a section on line B—B of FIG. 2, but including the tapes situated on the section line and, FIGS. 5 to 9 are longitudinal sections through different embodiments of tablets containing cut-outs of different forms.

DETAILED DESCRIPTION OF PREFERRED EMBODIMENTS

Figure 1:
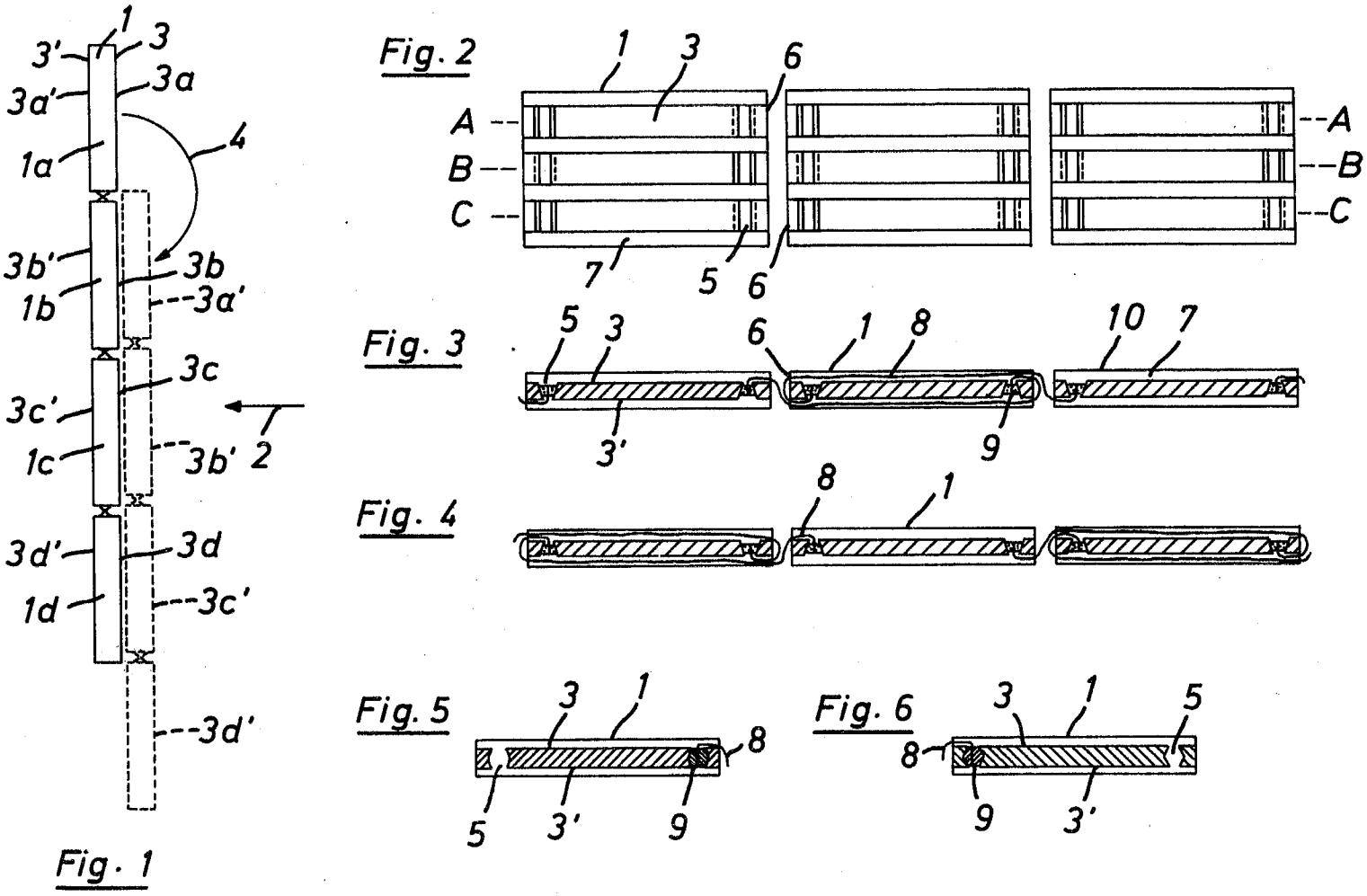
FIG. 1 is a schematic side-view of a first embodiment of toy to show the sequence of movement when the tablets turn over.

Referring now to the drawings, the toy shown in FIG. 1 consists of four rectangular tablets 1 or 1*a*, 1*b*, 1*c*, 1*d* which are all of the same shape and which are injected-moulded from a plastics material. When the first tablet 1*a* is held in the position shown, the other tablets 1*b*, 1*c*, 1*d* hang down in the way shown as a result of gravity. The direction in which the observer is assumed to be looking is shown by an arrow 2. The tablets 1 or 1*a*, 1*b*, 1*c*, 1*d* have faces 3 or 3*a*, 3*b*, 3*c*, 3*d* and 3' or 3*a'* 3*b'*, 3*c'*, 3*d'*. To an observer looking in the direction of arrow 2 it is the faces 3*a*, 3*b*, 3*c*, 3*d* of the tablets 1*a*, 1*b*, 1*c*, 1*d* which are visible while the faces 3*a'*, 3*b'*, 3*c'*, 3*d'* of the tablets are turned away from him. If however the first tablet 1*a* is turned down in front of the tablet 1*b* next below it, as indicated by arrow 4, the other tablets 1*b*, 1*c*, 1*d* which are not held automatically continue turning over to the position shown in broken lines, and the faces 3*a'*, 3*b'*, 3*c'*, 3*d'* of the tablets become visible to the observer looking in the direction of arrow 2.

From the plan view in FIG. 2, in which only the tablets are shown, it can be seen that the tablets 1 have cut-outs 5. The successive tablets 1 have their narrow sides 6 adjacent one another and the cut-outs are arranged beside one another in threes parallel to and at a distance from each narrow side 6. Also, the cut-outs 5 in the tablets 1 widen in the direction of alternate ones of the two faces 3 and 3' of the tablets, so that at each face 3 or 3' the smaller opening of a cut-out 5 is situated immediately next to and opposite the larger opening of another cut-out 5. The cut-outs 5 shown are trapezium-shaped in cross-section in the present case. It can also be seen in FIG. 2 that the tablets 1 have parallel longitudinal ridges 7 which extend as far as the cut-outs 5.

As can be seen in FIG. 3, the tablets are connected uninterruptedly together by tapes 8 so that they are able to move. The tapes have thickened end-pieces 9 made of plastics material whose shape allows them to be inserted into and to interengage with the cut-outs 5. The end-pieces 9 are injection-moulded onto the tapes 8. The tapes 8 are all of the same length.

In each case the tapes 8 emerge from the cut-outs 5 via the smaller opening, run around the nearest narrow side 6 of the same tablet 1 and across whichever is the opposite tablet face, 3 or 3', and terminate in a cut-out 5 in the adjoining tablet which corresponds to the first cut-out. This being so the end-pieces are a traction-resistant fit in their respective cut-outs 5. The dimensions of the end-pieces 9 are such that when turned through approximately 90° from their final position they can be inserted into the cut-out 5 for which they are intended through the smaller opening and can also be withdrawn from it again. The tapes 8 are guided at the sides and separated from one another by the longitudinal ridges 7.

As can also be seen in FIG. 3, the longitudinal ridges 7 have a surface 10 which extends parallel to the rest of the surface 3 or 3' of the tablets. If of suitable width, this surface can be used for lettering, patterns or the like. It in fact continues in a straight line from tablet to tablet and like the faces 3 and 3' of the tablets which lie between the cut-outs it is not even partly coverted by tapes 8.

In order that these sections of the faces 3 and 3' of the tablets which are partly covered by tapes 8 may also be used to carry lettering, patterns or the like, in another embodiment the tapes 8 are transparent. As a result the faces 3 and 3' of the tablets can be made to show marked visual differences for the observer, which increases the mystification of observers not in the secret, which is the object of the toy. Thus, it is for example possible to place a question on one face and to let the corresponding answer appear on the other face after the turn-over.

FIG. 4 shows how the tapes 8 extending along the margins are supplemented in the central area of the tablets 1. In the central area shown in FIG. 4, a tape 8 emerges from a given tablet 1 in the opposite direction from the tapes 8 at the margins which are shown in FIG. 3, runs on in the opposite direction and is connected to the tablet 1 which follows on at the opposite side.

The tablet 1 shown in FIG. 5 has inwardly convex cut-outs 5 whose inside width is greater than their width where they open onto the faces 3, 3' of the tablet. To enable the end-pieces 9 of tapes 8 to be inserted in the cut-outs 5, the end-pieces consist of a resilient plastics material so that they will deform and can be inserted through the openings of reduced size and into the cut-outs 5. In this embodiment all the cut-outs 5 have similar openings at both faces 3, 3' of the tablet. In this case too however the tapes 8 are arranged in the way shown in FIGS. 3 and 4.

Finally, the tablet 1 in FIG. 6 represents a modification to the subject of FIG. 5 in which, although the inside width of the cut-outs 5 is greater than the width of their openings at the faces 3, 3' of the tablet, the cross-sectional configuration is made up of straight lines. In this case too tapes 8 having end-pieces 9 of resilient material are provided.

Figure 7:
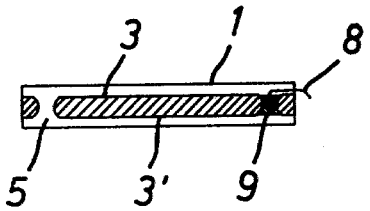
Figure 8:
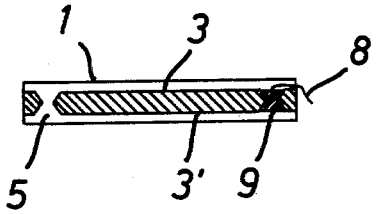

The tablets 1 shown in FIGS. 7 and 8 have cut-outs 5 whose inside width is smaller than the width of their openings at the faces 3, 3' of the tablet. The end-pieces 9 of the tapes 8 are once again adapted to suit. As in the embodiments in FIGS. 5 and 6, in the present case also, the end-pieces 9 consists of resilient material. In FIG. 7 the cut-outs have curved inside faces. In contrast to this, the cut-outs 5 in FIG. 8 have a cross-sectional configuration made up of straight lines.

Figure 9:
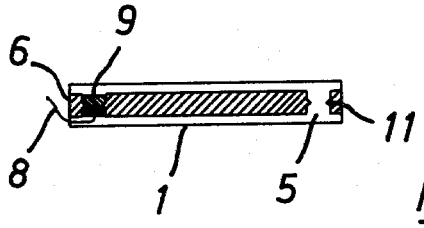

The tablet in FIG. 9 on the other hand has cut-outs 5 which are bounded by parallel inside faces. In this case the inside faces have two small ridges 11 which engage in corresponding recesses in the end-pieces 9 of the tapes 8 and thus fix the end-pieces 9 in position in the cut-outs 5.

In the embodiment shown the ridges are triangular in cross-section. They could equally well be of, inter alia, semicircular cross-section. It is also possible for only one inside face to be provided with a ridge 11 without any danger arising of the end-pieces accidentally escaping from the cut-outs 5. The ridges 11 lie at the same distance from face 3 as from face 3'. It is useful if either the end-pieces 9 or the tablets 1 consists of a resilient material or if the dimensions of the tablets 1 are such that slight deformation is possible for complete insertion and also subsequent removal of the end-pieces 9. This can be achieved simply by positioning the cut-outs 5 as close as possible to the narrow sides 6.

In the embodiments shown the narrow sides 6 are flat, chiefly for ease of manufacture; they could however be outwardly convex for example without departing from the scope of the invention as defined by the appended claims.

I claim:

1. In a toy comprising shaped tablets which are able to move under gravitational influence and which are connected uninterruptedly together by tapes to be able to move in such a way that, if a first said tablet is taken hold of and the other tablets are allowed to hang free, then one face of said tablets is visible, and, if said first tablet is turned down in front of the tablet next below it, then all the tablets which are not held automatically turn over, after which the other face of the tablets is visible, said toy comprising a plurality of tapes of equal length each having thickened end-pieces composed of resilient plastic material which is injection molded onto said tapes, each said tablet having opposite narrow ends and cut-out portions extending through said tablets adjacent each said end with each said cut-out portion having an enlarged area adjacent one surface and a smaller area adjacent the opposite surface of said tablet, said end-pieces being of resilient material and interengaged within said cut-out portions of said tablets and with said tapes extending from said smaller area of said cut-out portions, the cut-out portions at one end of each tablet having the smaller area on one surface thereof while the cut-out portions at the opposite end of said tablet having the smaller area on the opposite surface thereof.

* * * * *